United States Patent [19]

Michelfelder et al.

[11] 4,440,100

[45] Apr. 3, 1984

[54] METHOD OF INTRODUCING ADDITIVE INTO A REACTION GAS FLOW

[75] Inventors: Sigfrid Michelfelder; M. Yaqub Chughtai, both of Gummersbach, Fed. Rep. of Germany

[73] Assignee: L. & C. Steinmüller GmbH, Gummersbach, Fed. Rep. of Germany

[21] Appl. No.: 400,377

[22] Filed: Jul. 21, 1982

[30] Foreign Application Priority Data

Jul. 22, 1981 [DE] Fed. Rep. of Germany ..... 3128903

[51] Int. Cl.[3] ..... F23B 7/00; F23J 11/00

[52] U.S. Cl. ..... 110/343; 110/345; 44/4; 431/4

[58] Field of Search ..... 110/343, 344, 345; 44/4, 5; 431/4

[56] References Cited

U.S. PATENT DOCUMENTS

| | | | |
|---|---|---|---|
| 3,002,855 | 10/1961 | Phillips et al. | 110/343 |
| 3,067,018 | 12/1962 | Voorhees | 110/343 |
| 3,490,926 | 1/1970 | Lee et al. | 110/343 |
| 3,746,498 | 7/1973 | Stengel | 431/4 |
| 4,185,080 | 1/1980 | Rechmeier | 110/345 |
| 4,190,421 | 2/1980 | Hwa | 110/343 |
| 4,245,569 | 1/1981 | Fallon | 110/345 |
| 4,245,573 | 1/1981 | Dixit et al. | 110/343 |
| 4,253,408 | 3/1981 | Kramer | 110/343 |
| 4,256,703 | 3/1981 | Dixit et al. | 110/344 |
| 4,331,638 | 5/1982 | Michelfelder | 431/4 |
| 4,369,719 | 1/1983 | Engstrom et al. | 110/343 |
| 4,372,227 | 2/1983 | Mahoney et al. | 110/343 |

*Primary Examiner*—Henry C. Yuen

*Attorney, Agent, or Firm*—Becker & Becker, Inc.

[57] ABSTRACT

A method of continuously introducing additive, which is conveyed by gaseous and/or liquid carriers, into a turbulent reaction gas flow in the combustion chamber of a steam generator having dry ash withdrawal for selective removal, in a dry manner, of environmentally harmful gaseous noxious materials, such as sulfur, chlorine, and chlorine compounds, which are contained in a hot reaction gas flow which results after a complete or incomplete flame combustion of solid, liquid, or gaseous fuels. Depending upon the additive introduced, heat is stored and/or used for decomposition reactions. The additive, is first introduced at one or more input locations, due to locally different pressure conditions in the combustion chamber, into one or more recirculation flows which are within the system and are closed. The additive is subsequently withdrawn from these recirculation flows and is introduced into the reaction gas flow.

8 Claims, 1 Drawing Figure

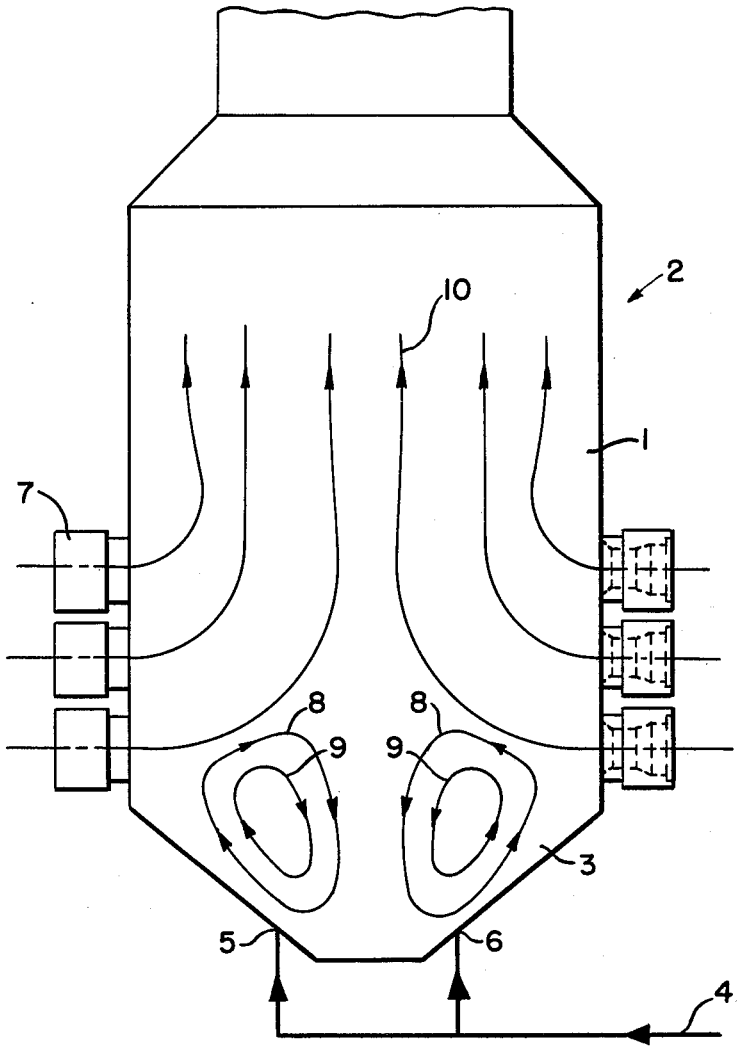
2
10
1
7
8
9
8
9
3
5
6
4

METHOD OF INTRODUCING ADDITIVE INTO A REACTION GAS FLOW

The present invention relates to a method of continuously introducing additive, which is conveyed by means of a gaseous and/or liquid carrier, into a turbulent reaction gas flow in the combustion chamber of a steam generator having dry ash withdrawal for selective removal, in a dry manner, of environmentally harmful gaseous noxious materials such as sulfur, chlorine, and chlorine compounds, which are contained in a hot reaction gas flow which results after a complete or incomplete flame combustion of solid, liquid, or gaseous fuels; at the same time, depending upon the additive introduced, heat is stored and/or required for decomposition reactions.

Methods are known according to which an additive, which is conveyed by means of a gaseous and/or liquid carrier, and which in a dry manner selectively scrubs a turbulent reaction gas flow of environmentally harmful gaseous noxious materials, such as sulfur, chlorine, and chlorine compounds, which reaction gas flow results from a complete or incomplete flame combustion of solid, liquid or gaseous fuel, is introduced in different ways into the combustion chamber.

According to a first method, the additive is introduced in the vicinity of the outlet of the combustion chamber through nozzles with the aid of air streams. A drawback to this method is that as a result of the relatively low energy of movement of the air streams, there is no uniform distribution of the additive in the reaction gas flow which contains the noxious material, as a result of which no great degree of bond between noxious materials and additive is achieved. Furthermore, the distribution of the additive in the reaction gas flow leads, due to already unfavorable temperature conditions, to reaction progress which, in comformity with the available retention time, is not optimal.

According to a second known method, the additive is mixed with the fuel directly in front of entry to the burner. An unfavorable aspect of this method is that the additive is subjected to a high thermal load in the immediate vicinity of the flame; this leads to deactivation of the additive.

According to a third method, the addition of the additive to the burner flame is effected by means of a gaseous and/or liquid carrier flow accompanied by the formation of a veil which surrounds the burner flame. Unfortunately, a partial deactivation of the additive as a result of the high flame temperature cannot be avoided. Furthermore, the structural and financial expense for carrying out this method is comparatively high.

It is an object of the present invention to provide a method with which the continuous introduction of additive into a reaction gas flow can take place under the aforementioned conditions at an optimum consumption of energy, and which, while simultaneously reaching favorable reaction conditions with regard to temperature, retention time, speed of reaction, thermal loadability of the additive, etc, leads to a uniform distribution of the additive in the reaction gas flow and to a great degree of bond between additive and the gaseous noxious materials.

This object, and other objects and advantages of the present invention, will appear more clearly from the following specification in connection with the accompanying drawing, which schematically illustrates one inventive application of the present method.

The method of the present invention is characterized primarily in that the additive is first introduced at one or more input locations, due to locally different pressure conditions in the combustion chamber, into one or more recirculation flows which are within the system and are closed; the additive is subsequently introduced from these recirculation flows into the reaction gas flow.

According to a further proposal of the present invention, the additive may be pulverous material such as calcium carbonate, magnesium carbonate, dolomite, and reactive oxide and hydroxide compounds, such as of the elements sodium, potassium, aluminum, barium, cadmium, calcium, copper, iron, lead, magnesium, manganese, and zinc. Furthermore, the carrier which conveys the additive may be a partial stream of the air of combustion, the flue gas, a mixture of the two, and/or a liquid, such as water.

In contrast to the known methods, the method of the present invention offers the advantage that the energy consumption necessary for introduction and subsequent distribution is now only minimally dependent upon the respective burner load in the combustion chamber, the retention time is increased, the uniform distribution of the additive in the reaction gas flow is improved, and a great degree of bond between additive and the gaseous noxious materials is achieved. Furthermore, the structural and financial expense for equipping a steam generator for the inventive method is minimal compared to all other known methods.

Referring now the the drawing in detail, in a combustion chamber 1 of a pulverized-coal-fired steam generator 2, the additive 4, which is conveyed by gaseous and/or liquid carrier, is continuously introduced into the funnel 3 provided for dry ash withdrawal at one or more preferred locations 5, 6. The number and location of the input locations 5, 6 depends upon the number and orientation of the recirculation flows 8, 9 which are within the system and are closed. The additive, as a function of the load of the burners 7, first passes with a mimimum amount of energy of movement into the recirculation flows 8, 9 which are caused by locally different pressure conditions in the combustion chamber, are within the system, and are closed. While a certain amount of additive, depending upon the loadability, remains in the closed recirculation flows for a while, another partial quantity of additive is constantly again carried out of these recirculation flows and is taken along by the turbulent reaction gas flow 10 which prevails in the combustion chamber 1.

During this transportation process, at the same time, depending upon the additive introduced, freed heat generated by the fuel is stored in the combustion chamber and/or is used for decomposition reactions, as a result of which the reaction temperature is locally lowered about the additive and consequently favorable reaction conditions occur in the combustion chamber as a result of the reduction of the high temperatures. Depending upon the effectiveness of the additive, part of the heat used for the additive is again available due to the exothermic sulfate formation reaction, so that no considerable reduction of the steam generator efficiency occurs. Finally, a uniform distribution of the additive in the reaction gas flow occurs; due to the favorable reaction conditions, this uniform distribution leads to a great degree of bond between additive and the gaseous noxious materials which are selectively to be separated in a dry manner.

The present invention is, of course, in no way restricted to the specific disclosure of the specification and drawing, but also encompasses any modifications within the scope of the appended claims.

What is claimed is:

1. A method for removing environmentally harmful gaseous material in the form of sulfur, chlorine and fluorine compounds contained in a hot reaction gas flow in the combustion chamber of a steam generator, wherein the combustion chamber has a side wall area in which a plurality of fuel inlets are positioned and a funnel-shaped portion which converges for dry ash removal, and wherein the combustion chamber further includes at least one inlet through the funnel-shaped portion which inlet is adjacent to a closed recirculation flow within the funnel portion, the method comprising the steps of:

during burning in the combustion chamber, introducing through the inlet a pulverous additive selected from the group consisting of calcium carbonate, magnesium carbonate, dolomite and reactive metal oxide and metal hydroxide compounds;

entraining the additive in the recirculation flow to intermix with and contact fuel burning in the combustion chamber to thereby interact with the burning fuel and combine sulfur, chlorine and fluorine compounds in the burning fuel with the pulverous additive to thereby remove the sulfur, chlorine and fluorine compounds from the burning fuel as ash, and removing the sulfur, chlorine and fluorine compounds from the combustion chamber in solid form upon removing the ash therefrom.

2. The method according to claim 1 which includes the step of entraining the pulverous additive in a stream of fluid to carry the additive into the recirculation flow.

3. The method according to claim 2 wherein the fluid is liquid.

4. The method according to claim 3 wherein the fluid is water.

5. The method of claim 2 wherein the fluid is flue gas.

6. The method of claim 5 wherein the fluid is combustion air.

7. The method of claim 2 wherein the fluid is a mixture of combustion air and flue gas.

8. The method of claim 1 wherein there are a plurality of inlets in the funnel-shaped portion.

* * * * *